United States Patent [19]

Lynn

[11] Patent Number: 4,770,308

[45] Date of Patent: Sep. 13, 1988

[54] CONTAINER AND CLOSURE ASSEMBLY HAVING INTERMEDIATE POSITIONING MEANS

[75] Inventor: Robert W. Lynn, Oxnard, Calif.

[73] Assignee: Becton, Dickinson and Company, Franklin Lakes, N.J.

[21] Appl. No.: 625,575

[22] Filed: Jun. 28, 1984

Related U.S. Application Data

[60] Continuation of Ser. No. 469,555, Feb. 25, 1983, abandoned, which is a division of Ser. No. 262,079, May 11, 1981, Pat. No. 4,387,822, which is a division of Ser. No. 084,883, Oct. 15, 1979; Pat. No. 4,289,248.

[51] Int. Cl.[4] ..... B65D 41/04

[52] U.S. Cl. ..... 215/330

[58] Field of Search ..... 215/330, 331, 217, 356, 215/307; 220/290

[56] References Cited

U.S. PATENT DOCUMENTS

| | | | |
|---|---|---|---|
| 2,532,729 | 12/1950 | Millstein | 215/331 X |
| 2,684,168 | 7/1954 | McGinnis et al. | 215/330 |
| 2,827,193 | 3/1958 | Martin | 215/217 |
| 3,682,345 | 8/1972 | Baugh | 215/330 |
| 3,952,899 | 4/1976 | Cooke | 215/217 |
| 4,053,077 | 10/1977 | DeFelice | 215/217 |
| 4,084,717 | 4/1978 | King | 215/31 X |
| 4,093,096 | 6/1978 | Augros | 215/330 |

*Primary Examiner*—Donald F. Norton

*Attorney, Agent, or Firm*—John L. Voellmicke

[57] ABSTRACT

A container having an open neck portion formed with a screw thread and a removable closure having a side wall portion formed with a mating screw thread. The closure has at least one protuberance on the side wall. The neck portion has at least one projection shaped to allow said protuberance to pass thereover in either direction when the closure is threaded on or off of the neck portion using an applied rotational force only. The projection extends downwardly away from the screw thread toward the neck portion/container interface. The protuberance requires an applied rotational force to enable same to pass over the projection wherein the closure can be partially unthreaded from the neck portion before the protuberance passes over the projection.

6 Claims, 3 Drawing Sheets

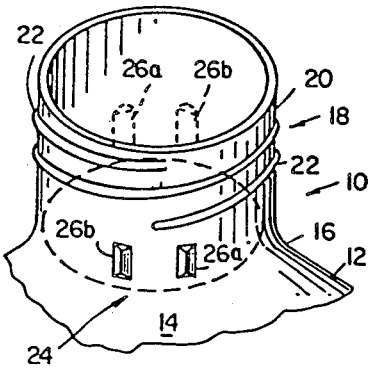
FIG. 1
FIG. 2
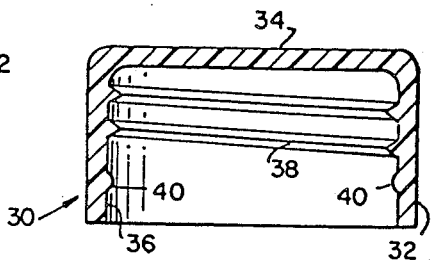
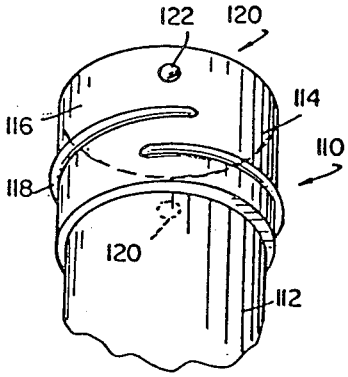
FIG. 3
FIG. 4
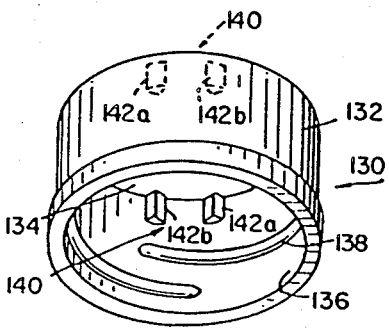

CONTAINER AND CLOSURE ASSEMBLY HAVING INTERMEDIATE POSITIONING MEANS

This application is a continuation of abandoned application Ser. No. 469,555, filed Feb. 25, 1983, which is in turn a divisional application of Ser. No. 262,079, filed May 11, 1981, now U.S. Pat. No. 4,387,822, which is in turn a divisional application of Ser. No. 084,883, filed Oct. 15, 1979, now U.S. Pat. No. 4,289,248.

This invention relates to a container-closure assembly, and more particularly to a container-closure assembly having means for intermediate cooperative positioning of such a closure with respect to the container therefor.

BACKGROUND OF THE INVENTION

The container and closure art is in a constant state of flux with new and improved container-closure assemblies being designed to solve new liquid handling and/or storage situations. There are assemblies designed for substantial positive closure cooperation with a container to prevent accidental spillage resulting from toppling, such as for example the thermoformed closures for expanded foamed containers for beverages, such as coffee and tea. Other container and closure assemblies have been designed for complete cooperate interlocking relationship to prevent the diffusion of a gaseous medium therefrom, such as container and closure assemblies for carbonated beverages. There are assemblies designed to provide for pressure relief during container-closure opening but prior to closure removal, such as disclosed in U.S. Pat. No. 4,007,851 to Walker. In U.S. Pat. No. 2,312,513 to Wilson, there is disclosed a silp-on closure for a container having neck engaging ribs to permit closure cooperation in a manner to prevent or minimize the free evaporation of the container contents.

There are container-closure assemblies used for bacterial studies where it is desirable to permit the introduction of a gaseous media, such as for sterilization or aerobic cultures. Such a closure is partially opened to a guesstimated extent determined by the user and returned to a container support assembly until future referral. Such a guesstimated relationship between the container and closure does not satisfy requirements of being: (a) loose enough for gaseous exchange with the contents in the container; and (b) sufficiently secured to prevent unintentional loss of closure-to-port contact.

OBJECTS OF THE INVENTION

An object of the present invention is to provide a novel container and closure assembly having means for positioning the closure on the container at a positive intermediate closure cooperating position.

Another object of the present invention is to provide a novel container and closure assembly having positive intermediate closure cooperating position to permit for the introduction of a gaseous media into the container.

Still another object of the present invention is to provide a novel container and closure assembly having means for positive intermediate closure cooperating position in a secured opened condition of the assembly.

Various other objects and advantages of the present invention will become apparent from the following description of embodiments thereof, and the novel features will be particularly pointed out in connection with the appended claims.

SUMMARY OF THE INVENTION

The present invention is directed to a novel container and closure assembly for material storage and having cooperating detent positioning assemblies to permit for a determinable closure cooperating position at any intermediate separation point from total closure cooperation with the container.

In a particularly preferred embodiment of the present invention, a neck of the container is provided with external threads including a detent positioning assembly comprised of a pair of outwardly extending projections formed on a plane perpendicular to the axis of the container. The closure or cap thereof is formed with internal threads for engaging the external threads of the container and a detent positioning assembly comprised of inwardly extending projections below the internal threads thereof. Threading of the closure or cap on the neck of such a container causes the inwardly extending projection of the closure to contact the initial downwardly extending projections provided on the neck of the container necessitating a slightly greater rotational force to be torsionally applied to cause the projections on the closure to over-ride the initial projection on the neck of the container thereby to place the projections of the closure intermediate the pair of outwardly extending projections on the container. The location of the projects of such assemblies are selected to positively position at a determinable intermediate location the interrelationship of the closure to the container. In the contrary sense, when the container and closure assembly are in total closure cooperation, the unthreading of the closure or cap from the neck of such a container is permitted to be effected until the other inwardly extending projections are caused to contact the final outwardly extending projections on the container necessitating a slightly greater rotational force to be torsionally applied to cause such closure projection to override the container projection thereby effecting positive position at such determinable intermediate location.

In one aspect of the present invention, one or both of the detent positioning assemblies may be formed in the manner to permit, at users option, the removal of such positioning capability.

BRIEF DESCRIPTION OF THE DRAWING

Understanding of the present invention will be facilitated by referring to the following detailed description in conjunction with the accompanying drawing, in which:

FIG. 1 is an isometric view of a top portion of a container illustrating one embodiment of the present invention;

FIG. 2 is a cross-sectional view of a closure or cap for the container of FIG. 1;

FIG. 3 is an isometric view of a top portion of a container illustrating another embodiment of the present invention;

FIG. 4 is an isometric view of a closure or cap for the container of FIG. 3.

DETAILED DESCRIPTION OF THE INVENTION

Figure 5:
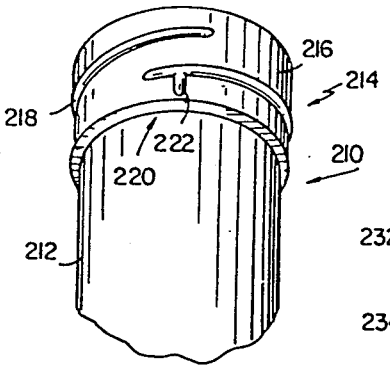
FIG. 5 is an isometric view of a top portion of another embodiment of the present invention.

Referring to FIG. 1, there is illustrated a container, generally indicated as 10, comprised of a body 12 forming a chamber 14 in which a material is adapted to be held until such time as the same is withdrawn or dispensed. It is unimportant whether the container body 12 is made of a collapsible or non-collapsible material, such as metals, plastics or glass. The body 12 at a narrowed skirt portion 16 is provided with a hollow neck, generally indicated by 18, and may be formed integral with the body 12 when the container 10 is formed or maybe otherwise formed and attached thereto at a later time. The manner in which the hollow neck 18 is connected to the body 12 of the container 10 is immaterial.

The exterior surface 20 of the neck 18 is formed with external threads 22. Below the external threads 22 on the exterior surface 20 of the neck 18, there is formed opposite one another detent positioning assembly, generally indicated as 24, comprised of a pair of outwardly-extending projections 26*a* and 26*b* extending beyond the cylindrical surface formed by the outer position of the threads 22.

The cooperating closure or cap for the container 10 of FIG. 1 is illustrated in FIG. 2 and is generally indicated as 30. The closure 30 is comprised of a cylindrically-shaped side wall portion 32 enclosed by a top wall 34. The interior surface 36 of the side wall 32 is formed with internal threads 38 of the double thread type. Beneath the internal threads 38 on the inner surface 36 of the cylindrically-shaped side wall 32, there are formed opposite one another, inwardly projections 40 dimensioned to extend to a point greater than the aforementioned cylindrical surface of the threads 22 of the container 10.

In operation of the container-closure assembly of FIGS. 1 and 2, upon initial positioning of the closure 30 on the neck 13 of the container 10, the projections 40 of the closure 10 pass over the external threads 22 formed on the container 10. Clockwise turning of the closure 30 about the neck 18 causes the internal threads 38 of the closure 30 to engage the external threads 22 of the container 10. Continued clockwise revolution of the closure 30 about the neck 18 of the container 10 eventually cause the projections 40 on the closure 30 to contact the first projection 26*a* of the pair of projections of the detent assembly 24 formed on the neck 18 of the container 10 whereby additional force is required to continue clockwise revolution to permit the projections 40 to override the projections 26*a*. Thereupon, further clockwise revolution cause the projections 40 of the cap 30 to engage the projection 26*b* of the detent assembly 24 whereby a further increase in force is required to permit the projections 40 to override such projections 26*b*. Total closure interrelationships between the closure 30 and the container 10 is effected by continued clockwise rotation until total frictional fit is achieved between the closure 30 with the container 10.

To permit the user to open the container 10 and to fix the closure 30 at the preselect intermediate closure position, the closure 30 need only be rotated counterclockwise to and passed the point where the projections 40 of the closure 30 override the projections 26*b* of the detent assembly 24 of the container 10. Thus, the closure 30 will be positioned on the container 10 at a point where the projections 40 of the closure 30 are disposed between the projections 26*a* and 26*b* of the detent assembly 24. In this manner, the user may readily open the container 10 and to arrest opening motion at a preselect position whereby with predetermined design conditions, the contents of the container 10 may be subject to ambient conditions, such as permitting the access of a gaseous medium, such as air into an aerobic culture contained therein under controlled condition of access. In this manner, the user is readily assured of preselect interrelationship of the closure 30 with the container 10 at a fixed point between an opened and full closure interrelationship.

It will be understood that the detent assembly may be provided with more than two projections and that the access opening of the container 10 as well as the thread configuration be designed for specific consideration of contact between the container contents and surrounding environment.

Referring now to FIGS. 3 and 4, illustrating another embodiment of the present invention, there is illustrated in FIG. 3 a container, generally indicated as 110, comprised of a container body 112 having an upper neck portion, generally indicated as 114. The exterior surface 116 of the neck portion 114 is formed with an external thread 118 of the single thread type. Above the thread 118 on the exterior surface 116 of the neck portion 114 is a detent positioning assembly, generally indicated as 120 and comprised of a pair of outwardly extending projections 122.

The closure for the container 110 of FIG. 4 is generally indicated as 130, referring now to FIG. 4 and is formed of a cylindrically-shaped side wall 132 enclosed by a top wall 134. An inner surface 136 of the side wall 132 is formed with internal thread 138, of the single thread type. Above the crests of the thread 138, there is formed detent assemblies, generally indicated as 140, formed of a pair of oppositely disposed inwardly extending barriers or projections 142*a* and 142*b*.

In operation of the container-closure assembly or FIGS. 3 and 4, the closure 130 is positioned over the neck 118 of the container 110 until the internal thread 138 thereof is caused to contact the external thread 118 of the container 110. Full interlocking relationship is obtained by causing the closure 130 to be clockwise rotated until full closure-container retationship is attained using additional force when necessary to permit the projections 142*a* and 142*b* of the detent assembly 140 of the closure 130 to override the outwardly extending projections 122 of the detent assembly 120 until the upper lip portion of the neck 114 of the container 110 is in contact with lower surface of the top wall 134.

In order to obtain a preselect intermediate closure operating position, such as discussed hereinabove with regard to the container-closure assembly of FIGS. 1 and 2, the user causes the closure 130 to be rotated in a counter clockwise direction to the point at which the barriers or projections 142*b* of the closure 130 contacts the projections 122 of the detent assembly 120 whereupon a slight additional force is required to override such projectons 122 thereby positioning the projections 122 of the container 110 at a point intermediate the projections 142*a* and 142*b* of the detent assembly 140 of the closure 130, Referring now to FIG. 5, there is illustrated a container, generally indicated as 210, comprised of a body 212 forming a chamber in which a material is adapted to be held until such time as the same is withdrawn or dispensed. The body 212 is provided with a neck, generally indicated by 214, and may be formed integral with the body 212 as hereinabove discussed. The exterior surface 216 of the neck 214 is formed with an external thread 218 of the single thread type. Extending downwardly from thread 218 on the exterior surface 216 of the neck 214, there is formed a detent positioning assembly, generally indicated as 220, comprised of a downwardly extending projection 222.

Figure 6:
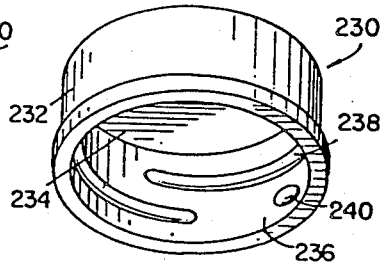
FIG. 6 is an isometric view of a closure or cap for the container of FIG. 5.

The cooperating closure or cap for the container 210 of FIG. 5 is illustrated in FIG. 6 and is generally indicated as 230. The closure 230 is comprised of a cylindrically-shaped side wall portion 232 enclosed by a top wall 234. The interior surface 236 of the side wall 232 is formed with internal thread 238 of the single thread type. Beneath the interior thread 238 on the inner surface 236 of the cylindrically-shaped side wall 232, there is formed an inwardly extending projection 240 disposed on at a point on the extension of the helix of the thread 238 of the cup 230.

In operation of the container-closure assembly of FIGS. 5 and 6, upon initial positioning of the closure 230 on the neck 214 of the container 210, the thread 238 of the closure 210 contacts the upper portion of external threads 218 formed on the container 210. Clockwise turning of the closure 230 about the neck 214 causes the internal thread 238 of the closure 230 to engage the external thread 218 of the container 210. Continued clockwise revolution of the closure 230 about the neck 218 of the container 210 eventually causes the projection 240 on the closure 230 to contac the projection 222 of the detent assembly 220 formed on the neck 218 of the container 210 whereby additional force is required to continue clockwise revolution to permit the projection 240 to override the projection 222 with total closure 230 interrelationship with the container 210 being effected by continued clockwise rotation until total frictional fit is achieved between the closure 230 with the container 210. To permit the user to open the container 210 and to position the closure 230 in a preselect intermediate closure range of such container-closure assembly, the closure 230 need only be rotated counterclockwise to a point at which the projection 240 of the closure 230 contacts the projection 222 of the detent assembly 220 of the container 210. Thus, the range is any point between total container-closure cooperation and projection contact.

Figure 7:
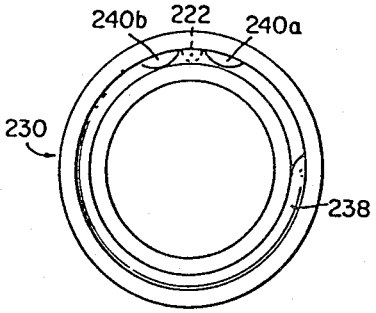
FIG. 7 is a bottom sectional of the container of FIG. 5 and a modified closure of FIG. 6 in a positive intermediate closure cooperating position.
Figure 8:
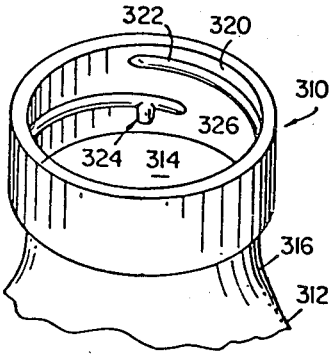
FIG. 8 is an isometric view of a top portion of a container illustrating still another embodiment of the present invention.
Figure 9:
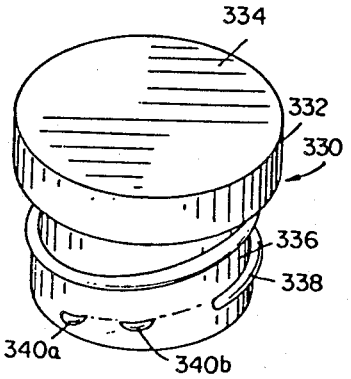
FIG. 9 is an isometric view of a closure or cap for container of FIG. 8.

FIG. 7 illustrates a closure 230 having a pair of inwardly extending projections 240*a* and 240*b* whereby the closure 230 may be positioned on the container 210 at a point where the projection 222 of the container 210 is disposed between the projecting 240*a* and 240*b* of the closure 230. The container-closure embodiment of present invention illustrated in FIGS. 8 and 9 are similar to that of FIGS. 5 and 6, except that the threading relationship is reversed compared to that of FIGS. 5 and 6. Referring to FIG. 8, there is illustrated a container, generally indicated as 310, comprised of a body 312 forming a chamber 314 in which a material is adapted to be held until such time as the same is withdrawn or dispensed. The body 312 at a narrowed skirt portion 316 is provided with a hollow neck, generally indicated by 318, and may be formed integral with the body 312 as hereinabove discussed. The interior surface 320 of the neck 314 is formed with an internal thread 322 of the single thread type. Extending downwardly from the internal thread 322 on the interior surface 320 of the neck 314, there is formed a detent positioning assembly, generally indicated as 324, comprised of a downwardly extending projection 326.

The cooperating closure or cap for the container 310 of FIG. 8 is illustrated in FIG. 9 and is generally indicated as 330. The closure 330 is comprised of an upper cylindrically-shaped side wall portion 322 enclosed by a top wall 334 and a lower cyclindrically-shaped side wall portion 336 dimensioned to be received in close fitting relationship within the neck 318 of the container 310 defined by the interior surface 320 thereof. The exterior surface of the side wall 336 is formed with an external thread 338 of the single thread type. Extending on the helix angle and beneath the thread 338 on the exterior surface of the side wall 336, there are sequentially formed outwardly extending projections 340*a* and 340*b*.

The operation of the container-closure assembly of FIGS. 8 and 9 is similar to the embodiment hereinabove discussed.

Figure 10:
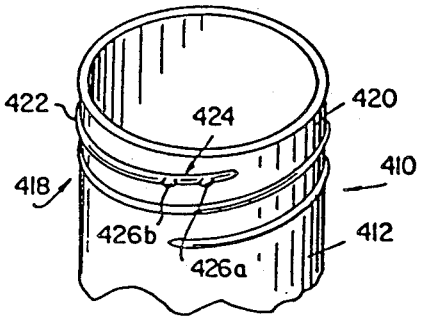
FIG. 10 is an isometric view of a top portion of a container illustrating still another embodiment of the present invention.
Figure 11:
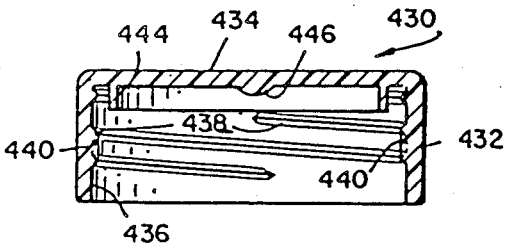
FIG. 11 is a cross-sectional view of a closure or cap for the container of FIG. 10.

Referring now to FIGS. 10 and 11, there is illustrated still another embodiment of the present invention. In FIG. 10, there is depicted a container, generally indicated as 410, comprised of a container body 412 having an upper hollow neck portion of like diameter, generally indicated as 418. The exterior surface 420 of the neck portion 418 is formed with an external threads 422 of the double thread type. The upper leading portions of the threads 422 is formed with a detent positioning assembly, generally indicated as 424 and comprised of a pair of projections 426*a* and 426*b* extending outwardly from the threads 422.

The closure for the container 410 of FIG. 10 is generally indicated as 430, referring now to FIG. 11 and is formed a cylindrically-shaped side wall 432 and enclosed by a top wall 434. An inner surface 436 of the side wall 432 is formed with internal threads 438 of the double thread type. Between crests of the threads 438, there is formed opposite one another inwardly extending barriers or projections 440. An inner surface 442 of the top wall 434 is formed with a downwardly extending cylindrically-shaped intermediate side wall section 444 which cooperates with the inner surface 436 of the side wall 432 to provide for effective closure-container integrity. Centrally formed on the inner surface 442 of the top wall 434 is a downwardly extending protuberance 446 which functions to assist in the condensation of vapors.

In operation of the container-closure assembly of FIGS. 10 and 11, the closure 430 is positioned over the neck 418 of the container 410 until the internal threads 438 thereof are caused to contact the external threads 422 of the container 410. Full interlocking relationship is obtained by causing the closure 430 to be clock-wiser rotated until full closure-container relationship is obtained using additional force when necessary to permit the projections 440 of the closure 430 to over-ride the outwardly extending projections 426*a* and 426*b* of the detent assembly 424 until the upper lip portion of the neck 414 of the container 410 is fully recessed within the area defined by the inner surface 436 of the closure 432 with the outer surface of the intermediate sidewall section 444.

In order to obtain a preselect intermediate closure cooperating position, such as discussed hereinabove with regard to the previous embodiments container closure assemblies of the present invention, the user causes the closure 430 to be rotated in a counter clockwise direction to the point at which the barriers or projections 440 of the closure 410 contact the initial projection **426*b* of the detent assembly 424 whereupon a slight additional force is required to override such projection 426*b* thereby positively placing the closure 430 on the container 410 at a point intermediate the projections 426*a* and 426*b* of the detent assembly 424. In the embodiment of FIGS. 10 and 11, it is contemplated that the projections 426*a* and 426*b* of the detent assembly 424** may be readily removed at the users discretion by filing, cutting, severing or like processing step.

While the various embodiments of the present invention have been described with reference to right hand threads of the single and double thread type, it will be understood that left hand threads of like thread types may also be used as well as other thread types. It will be understood that the projecting dimensions of the detent assemblies are selected such that the rotational force is readily recognizable to user during manual manipulation to alert the user to the intermediate separation point, position or range. It will be appreciated that the detent assemblies may also be sized and dimensioned to produce a sound, such as a click, at each point within a position and/or range to permit user selection of such a specific point of container-closure cooperation. In use, operation of the container-closure assemblies have been discribed with reference to attaining a preselect intermediate position by reaching the same from full container-closure cooperation. It will be understood that such a position may also be reached from and through initial container-closure cooperation.

Additionally, the embodiments of the present invention have been discussed with reference to detent positioning assemblies of one or two projections, however, it is contemplated that the detent positioning assembly may be comprised of three or more projections in a preselect manner to quantitatively defined the varying cross-sectional area of opening between the container and the closure. The detent positioning assemblies, as hereinabove discussed, may be formed in a manner which permits facile removal at users discretion by filing, cutting, severing or the like.

Various changes in the details, materials and arrangement of parts, which have been described and illustrated in order to explain the nature of the invention, may be made by those skilled in the art within the principle and scope of the invention as defined in the appended claims.

What is claimed:

1. In combination a container having an open neck portion formed with threadable engaging means and a removable closure having a side wall portion formed with mating threadable engaging means, said closure including an end covering said neck portion for sealing said container closed and at least one protuberance on said side wall thereof; at least one projection on said neck portion, said projection being shaped to allow said protuberance to pass thereover in either direction when said closure is threaded on or off of said neck portion using an applied rotational force only, said projection extending downwardly away from said threadable engaging means toward the neck portion/container interface, said protuberance requiring an applied rotational force to enable same to pass over said projection wherein said closure can be partially unthreaded from said neck portion before said protuberance passes over said projection.

2. The container of claim 1 wherein said projection is connected to said threadable engaging means.

3. The container of claim 1 wherein said projection is oriented in a substantially vertical direction.

4. The container of claim 1 further including a second protuberance adjacent to said one protuberance, said second protuberance and said one protuberance containing said projection therebetween when said closure is partially unthreaded from said neck portion.

5. The container of claim 1 further including a second projection extending downwardly away from said threadable engaging means toward the neck portion/-container interface, said second projection and said projection being oppositely disposed.

6. In combination, a container having an open neck portion formed with threadable engaging means and a removable closure having a side wall portion formed with mating threadable engaging means, said closure including an end covering said neck portion for sealing said container closed; at least one projection on said neck portion; at least one protuberance on said side wall of said closure, said projection being shaped to allow said protuberance to pass thereover in either direction when said closure is threaded on or off of said neck portion using an applied rotational force only, said protuberance requiring an applied rotational force to enable same to pass over said projection wherein said closure can be partially unthreaded from said neck portion before said protuberance passes over said projection.

* * * * *